US009740137B2

(12) United States Patent
Takeuchi

(10) Patent No.: US 9,740,137 B2
(45) Date of Patent: Aug. 22, 2017

(54) IMAGE FORMING APPARATUS HAVING ALTERNATING CURRENT BIAS CONTROL

(71) Applicant: CANON KABUSHIKI KAISHA, Tokyo (JP)

(72) Inventor: Kosuke Takeuchi, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/091,884

(22) Filed: Apr. 6, 2016

(65) Prior Publication Data

US 2016/0313665 A1 Oct. 27, 2016

(30) Foreign Application Priority Data

Apr. 24, 2015 (JP) ..... 2015-089093

(51) Int. Cl.
*G03G 15/08* (2006.01)
*G03G 15/09* (2006.01)
*G03G 15/06* (2006.01)

(52) U.S. Cl.
CPC ..... *G03G 15/065* (2013.01); *G03G 15/0907* (2013.01); *G03G 2215/0648* (2013.01)

(58) Field of Classification Search
CPC ..... G03G 15/065; G03G 15/0907; G03G 2215/0648
USPC ..... 399/55, 269, 270
See application file for complete search history.

(56) References Cited

U.S. PATENT DOCUMENTS

2006/0104674 A1* 5/2006 Tamaki ..... G03G 15/0907 399/269
2012/0213557 A1* 8/2012 Yamaguchi ..... G03G 15/0813 399/269
2016/0054675 A1 2/2016 Takeuchi et al.

FOREIGN PATENT DOCUMENTS

| | | | |
|---|---|---|---|
| JP | 2004-029569 | A | 1/2004 |
| JP | 2004-198564 | A | 7/2004 |
| JP | 2004-198815 | A | 7/2004 |
| JP | 2007-333819 | A | 12/2007 |
| JP | 4194360 | B2 | 12/2008 |
| JP | 2011-191664 | A | 9/2011 |
| JP | 4939118 | B2 | 5/2012 |

* cited by examiner

*Primary Examiner* — Sophia S Chen
(74) *Attorney, Agent, or Firm* — Fitzpatrick, Cella, Harper & Scinto

(57) ABSTRACT

An image forming apparatus includes an image bearing member and a developing device having a first developer bearing member and a second developer bearing member, disposed with a gap therebetween. A controller executes a mode in which a first difference between an amplitude of an alternating current bias of a first developing bias applied to the first developer bearing member and an amplitude of an alternating current bias of a second developing bias applied to the second developer bearing member at a time of non-image formation is set to be large compared to a second difference between an amplitude of the alternating current bias of the first developing bias applied to the first developer bearing member and an amplitude of the alternating current bias of the second developing bias applied the second developer bearing member at a time of image formation.

11 Claims, 12 Drawing Sheets

*FIG. 11*

| | NUMBER OF HT STREAKS | DIFFERENCE IN DENSITY OF STREAK PORTION |
|---|---|---|
| CONVENTIONAL EXAMPLE | 12 | 0. 3 |
| FIRST EMBODIMENT | 5 | 0. 1 |
| SECOND EMBODIMENT | 3 | 0. 06 |
| THIRD EMBODIMENT | 1 | 0. 03 |

IMAGE FORMING APPARATUS HAVING ALTERNATING CURRENT BIAS CONTROL

BACKGROUND OF THE INVENTION

Field of the Invention

The present invention relates to an image forming apparatus which includes a developing device equipped with a plurality of developer bearing members which bears a developer for developing an electrostatic latent image on an image bearing member.

Description of the Related Art

Conventionally, in a copying machine using an electrophotographic system, a laser beam printer, a facsimile machine, and an image forming apparatus such as a printing apparatus, the surface of an image bearing member is evenly charged, an image is exposed by a semiconductor laser or an LED, and an electrostatic latent image is formed on the image bearing member. Then, after the electrostatic latent image is visualized as a developer image by a developing device, the visible image (the developer image) is transferred onto a transfer material, and the transferred visible image is fixed to the transfer material by a fixing apparatus and output.

In recent years, high speed and high quality have been strongly requested for the image forming apparatus. As a developing device used in the image forming apparatus capable of making a high-speed output, there is a configuration which includes a plurality of developer bearing members for bearing the developer.

Since the developer can be supplied to the electrostatic latent image on the image bearing member any number of times using the plurality of developer bearing members, an appropriate density can be kept even when the operation is increased in speed. In addition, since the toner attached to the image bearing member by the developer bearing member on the upstream side in the rotation direction of the image bearing member is once peeled off by the developer bearing member disposed on the downstream side in the rotation direction and is attached again, it is possible to obtain an image more faithful to the latent image.

As a way of disposing the plurality of developer bearing members, as disclosed in Japanese Patent Laid-Open No. 2011-191664 or Japanese Patent Laid-Open No. 2004-29569, a configuration that the plurality of developer bearing members abuts in a short distance, and a configuration that the developer bearing members are disposed in a separated distance.

In Japanese Patent Laid-Open No. 2011-191664, the plurality of developer bearing members is disposed to be separated from each other, and a regulating member is provided to regulate the developer on each developer bearing member. However, the configuration that the developer bearing members are disposed to abut can be made simple compared to the configuration that the developer bearing members are disposed to be separated, and can be made in small size so that the configuration is received a lot of attention in recent years.

In the configuration that the developer bearing members are disposed to abut, the developer bearing members on the downstream side except the developer bearing member on the most upstream side are disposed with a gap with respect to one developer bearing member on the upstream side in a non-contact manner, and the developer on the developer bearing member is regulated by the gap. The developer amount on the developer bearing member can be adjusted by adjusting the gap between the developer bearing members (see Japanese Patent Laid-Open No. 2004-29569). With such a configuration, it is possible to achieve high speed and high quality by a simply configuration.

However, in the configuration disclosed in Japanese Patent Laid-Open No. 2004-29569, in a case where the apparatus is downsized, an agglomerate is accumulated between the developer bearing members which perform the regulation of the developer. Therefore, there occurs a phenomenon of inhibiting a coat layer of the developer on the developer bearing member. When an image is formed in such a circumstance that the coat layer of the developer bearing member is inhibited, an image defect such as a vertical streak in half tone is generated. In addition, a surface property of the developer bearing member is changed depending on an external temperature/humidity circumference. Therefore, a trace may be generated in the developer bearing member.

SUMMARY OF THE INVENTION

It is desirable to prevent an image defect such as a vertical streak caused by an agglomerate accumulated on a facing portion between a plurality of developer bearing members even when the apparatus is downsized.

In order to solve the above issue, an image forming apparatus of the present invention includes: an image bearing member; a developing device that is disposed along a rotation direction with respect to the image bearing member, includes a first developer bearing member and a second developer bearing member which bears a developer, and regulates the developer of the second developer bearing member by the first developer bearing member by disposing the first developer bearing member disposed on an upstream side in the rotation direction of the image bearing member and the second developer bearing member disposed on a downstream side in the rotation direction of the image bearing member with a gap therebetween in a non-contact manner; a bias application portion that is used to apply a developing bias to the first developer bearing member and the second developer bearing member; and a controller that controls the developing bias applied to the first developer bearing member and the developing bias applied to the second developer bearing member, wherein the controller is configured to apply an oscillation bias between the first developer bearing member and the second developer bearing member, and wherein the controller is configured to execute a mode in which an amplitude of the oscillation bias applied between the first developer bearing member and the second developer bearing member at the time of non-image formation is set to be large compared to the amplitude at the time of image formation.

According to the invention, an oscillation bias generates oscillations between the plurality of developer bearing members, and the agglomerate of the developer is cracked down by the oscillation. Therefore, it is possible to prevent an image defect such as a vertical streak due to the agglomerate in the portion facing the plurality of developer bearing members in a non-contact manner using a simple configuration even when the apparatus is downsized.

Further features of the present invention will become apparent from the following description of exemplary embodiments with reference to the attached drawings.

BRIEF DESCRIPTION OF THE DRAWINGS

FIG. 11 is a table showing experimental results according to the first, second, and third embodiments.

DESCRIPTION OF THE EMBODIMENTS

Hereinafter, embodiments of a developing device and an image forming apparatus according to the invention will be described using the drawings. Further, the developing device is used, for example, in the image forming apparatus as described below, but the configuration is not limited thereto. Further, the portions described in the background art will not be repeated.

In addition, dimensions, materials, shapes, and relative arrangement of components described in the following embodiments may be suitably changed depending on a configuration or various conditions of the apparatus of the invention. Therefore, if not otherwise specified, there is no purpose of limiting the scope of the invention only to these embodiments.

First Embodiment

Figure 12:
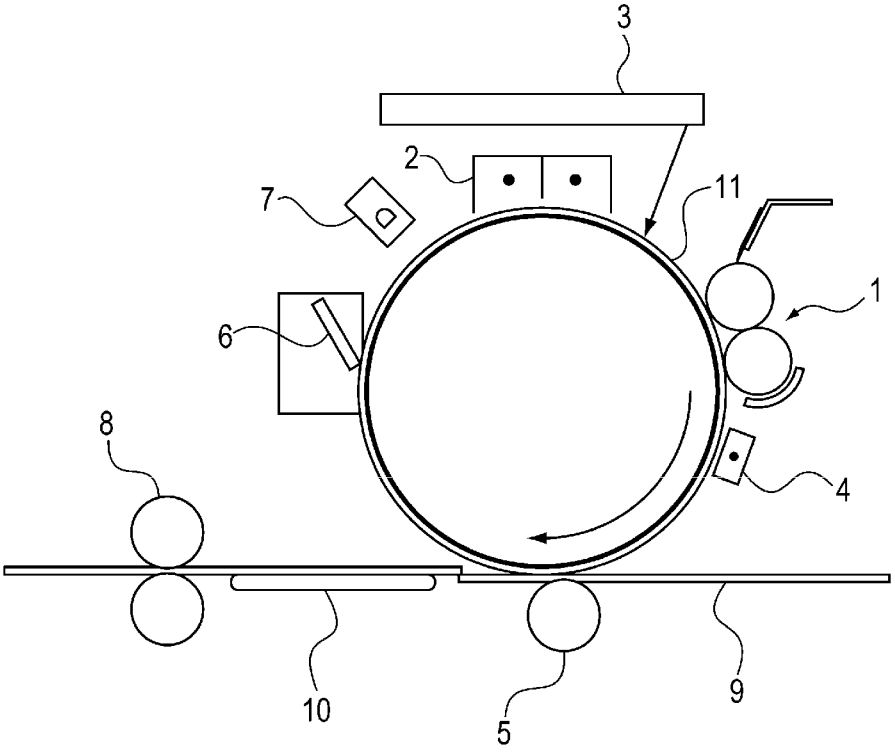
FIG. 12 is a cross-sectional view schematically illustrating the entire configuration of the image forming apparatus.

FIG. 12 is a cross-sectional view schematically illustrating a configuration of the image forming apparatus. In FIG. 12, a monochrome high-speed copying machine is illustrated as an example of the image forming apparatus.

The following description will be made using the monochrome high-speed copying machine as illustrated in FIG. 12. The drum of the copying machine has a diagram of ϕ60 mm, and 75 ppm.

The image forming apparatus illustrated in FIG. 12 includes a photosensitive member 11, a development device 1, a corona charger 2, a laser scanner 3, a post charger 4, a transfer roller 5, a cleaning unit 6, a pre-exposure device 7, a fixing device 8, a sheet 9, and a sheet conveyance belt 10.

When the photosensitive member 11 serving as an image bearing member (a member bearing an electrostatic latent image) charged by the corona charger 2 is irradiated with the light emitted from the laser scanner 3 and the charges are blown out, the latent image is formed on the photosensitive member 11. In the development device 1, the latent image written on the photosensitive member 11 by the charges is developed as a toner image (a developer image) by supplying the charged toner (developer) to the photosensitive member 11 using an electric field. Thereafter, the toner further charged by the post charger 4 is transferred onto a sheet 9 serving as a transfer material by the transfer roller 5, and the transferred toner image is fixed to the sheet 9 by the fixing device 8. On the other hand, the toner not transferred but left on the photosensitive member 11 is scraped off by a blade of the cleaning unit 6, and the charges on the photosensitive member 11 are uniformly attenuated in a thrust direction by the pre-exposure device 7. Thereafter, the photosensitive member 11 is charged again by the corona charger 2.

The photosensitive member 11 is configured by an organic photosensitive member, an amorphous-silicon photosensitive member, or the like. A plurality of developing sleeves (developer bearing members) provided in the photosensitive member 11 and the development device 1 face each other with a predetermined gap therebetween in a non-contact manner. Specifically, the plurality of developing sleeves faces each other with a gap of about 100 to 400 μm therebetween in a non-contact manner, and preferably a gap of about 150 to 300 μm. The toner used in the development device 1 is a magnetic one-component comminuted toner, and is classified to a size of 3 to 10 μm. In addition, as a charge control agent, silica, titanium oxide, fine strontium titanate particles having a size of 0.1 μm or less are added as an external additive.

In this embodiment, a BAE (background exposure system) is employed, the photosensitive member 11 is charged at Vd=550 V by the corona charger 2, and a non-image portion is exposed by the laser scanner 3, so that the potential falls down to V1=150 V. Then, the developing sleeve of the development device 1 is applied with 250 V as a DC component, and the negatively charged toner is developed at a place of the non-exposure portion Vd.

Figure 1:
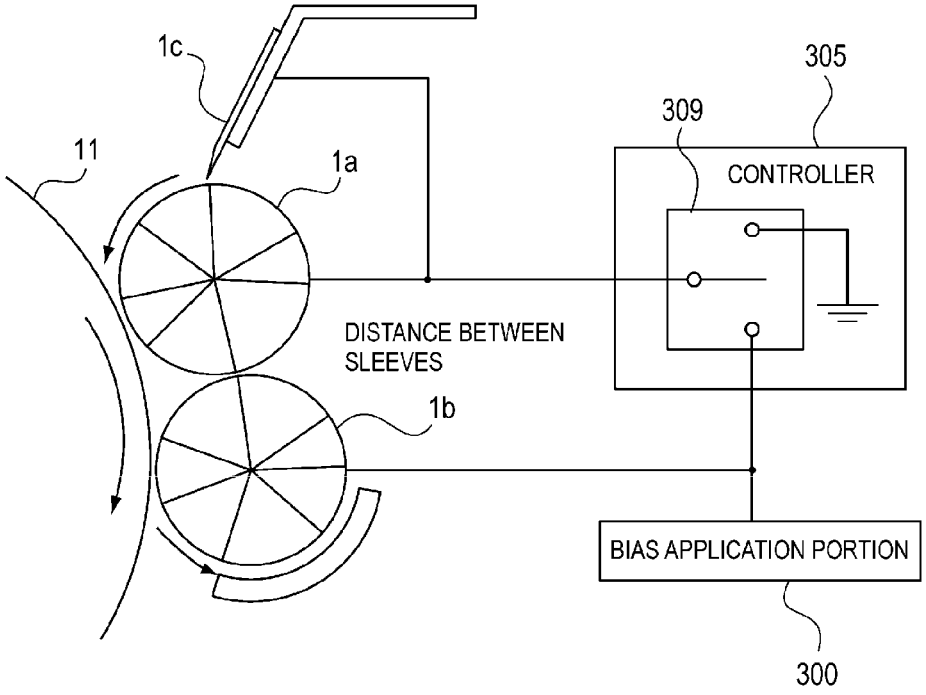
FIG. 1 is a cross-sectional view schematically illustrating an example of a configuration of a developing device in an image forming apparatus according to a first embodiment.

Next, the development device 1 serving as the developing device will be described using FIG. 1. FIG. 1 is a cross-sectional view schematically illustrating an example of a configuration of the developing device in an image forming apparatus according to the first embodiment. As illustrated in FIG. 1, the development device 1 is disposed along a rotation direction with respect to the photosensitive member 11, and includes a plurality of developing sleeves 1*a* and 1*b* which bears the toner (developer). The developing sleeve 1*a* is a first developer bearing member which is disposed on the upstream side in the rotation direction of the photosensitive member 11. On the other hand, the developing sleeve 1*b* is a second developer bearing member which is disposed on the downstream side in the rotation direction of the photosensitive member 11. The developing sleeve 1*b* on the downstream side in the rotation direction is disposed at a predetermined gap in a non-contact manner with respect to the developing sleeve 1*a*, and regulates the toner of the developing sleeve 1*b* by the developing sleeve 1*a*.

The developing sleeves 1*a* and 1*b* serving as the plurality of developer bearing members are made in a cylinder shape which bear the toner on the surface and are rotated to convey the toner. A portion which is not in contact with but near the photosensitive member 11 is a developing region. The developing sleeves 1*a* and 1*b* are made such that a round bar or a pipe made of aluminum or stainless steel having a diameter of about 10 to 40 mm (30 mm in this embodiment) is cut, provided with a semiconductor layer such as a phenol resin on the circumferential surface, and mechanically polished to have surface roughness of Ra=0.1 to 1.0 μm (preferably, 0.6 to 0.9 μm). In addition, the developing sleeve may be made such that a round bar or a pipe made of aluminum or stainless steel is cut, and mechanically polished by sandblasting, liquid honing, or emery polishing in a circumferential surface or chemically corroded so as to form irregularities of about Ra=0.1 to 1.0 μm, or an aluminum roll is mechanically polished and subjected to anodic oxidation treatment. In a case where the semiconductor layer is formed in the circumferential surface of the developing sleeve, a volume resistance value in the thickness direction of the surface layer of the developing sleeve becomes about $10^5$ to $10^{12}$ Ω·cm. In addition, a fixed magnetic pole is disposed in the developing sleeve.

A regulation blade 1*c* serving as a developer layer thickness regulating portion (a developer regulating member) is configured by a regulation blade body made of a ferromagnetic material having a thickness of about 1 to 4 mm, and a supporting plate made of a non-magnetic material such as SUS. The tip of the regulation blade 1*c* is cut in a knife edge shape having a width of about 1 to 10 mm from the developing sleeve, and the thickness of the tip is about 0.1 to 0.3 mm. The tip of the regulation blade 1*c* is disposed to face the developing sleeve 1*a* with a distance of 150 to 300 μm therebetween, and to face a magnetic pole N1 disposed in the developing sleeve 1*a*. With such an arrangement, the magnetic field is generated between the tip of the regulation blade 1*c* and the magnetic pole in the developing sleeve 1*a*, so that the developing sleeve 1*a* is coated with the magnetic toner by an even thickness of about 0.7 to 1.2 (g/cm$^2$), and the charges of about 4 to 15 μC/g are supplied.

The diameters of the photosensitive member 11 and two developing sleeves 1*a* and 1*b* are 90 mm, 20 mm, and 18 mm, respectively. The photosensitive member 11 and two developing sleeves 1*a* and 1*b* are rotated at speeds of vd, va, and vb in directions of arrows, respectively. In this configuration, the speeds are set as vd=450 mm/sec, va=460 mm/sec, and vb=440 mm/sec. Furthermore, the developing sleeve 1*a* serving as the first developer bearing member is disposed in parallel with the photosensitive member 11 and the regulation blade 1*c* with gaps of 250 μm and 240 μm, respectively, therebetween. The developing sleeve 1*b* serving as the second developer bearing member is disposed with a gap of 300 μm with respect to the photosensitive member 11, and in parallel with the developing sleeve 1*a* with a gap of 400 μm therebetween.

In addition, as illustrated in FIG. 1, the developing sleeves 1*a* and 1*b* and the regulation blade 1*c* are connected to a developing bias application portion 300 which applies an AC bias (an alternating current bias) and a DC bias (a direct current bias) in a superimposing manner. In addition, the developing sleeve 1*a* and the regulation blade 1*c* are connected to a switch 309 serving as a switching portion which can cause the electrical separation from the developing sleeve 1*b* (see FIG. 3). The developing sleeve 1*a* and the regulation blade 1*c* are at 0 V (earth connection) in the separation state.

Figure 2:
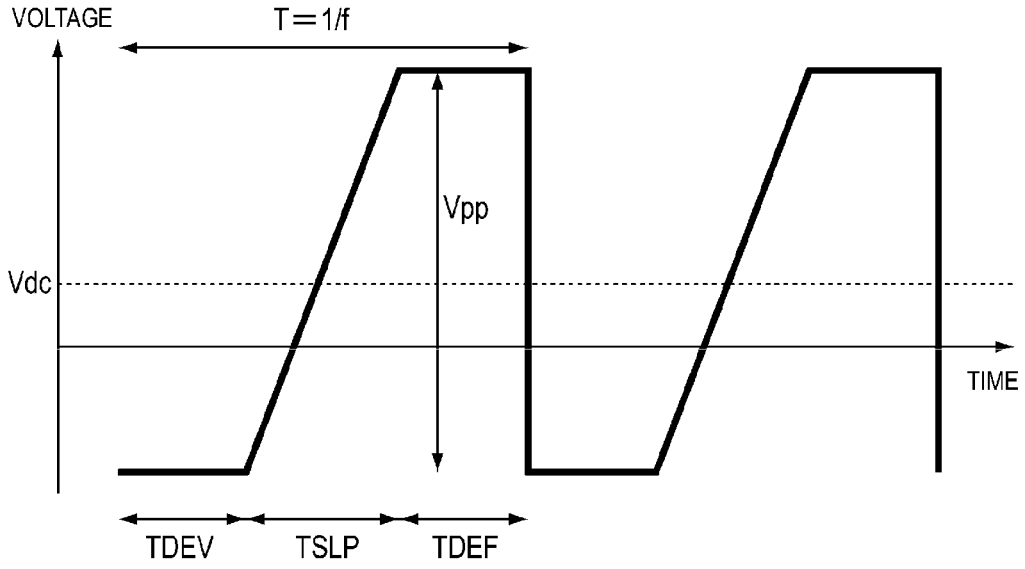
FIG. 2 is a diagram illustrating a slope bias used in an embodiment in which a DC component and an AC component are intermittently superimposed.

In this embodiment, as a developing bias to be applied to the developing sleeve, a slope bias is used in which the AC component (the alternating component) is intermittently superimposed on the DC component (the direct current component) illustrated in FIG. 2. Vdc in FIG. 2 indicates the DC component, and the developing bias becomes the waveform as illustrated in FIG. 2 by superimposing the AC component on the center of the DC component. In this way, roughness of an image can be suppressed and the image density can be sufficiently obtained by adding the AC component (an AC developing bias voltage) to the DC component (a DC developing bias voltage). The amplitude Vp-p of the AC component (the AC developing bias voltage) of the developing bias voltage is 2 kV, and the frequency f is 3 kHz. In the slope bias, the toner is developed at the time of TDEV, and the residual toner is recovered at the time of TDEF. In addition, the slope is smoothly biased from TDEV to TDEF at the time of TSLP so as not to make the toner pull out of the latent image due to a steep variation in bias. In this embodiment, a ratio between these regions is set to be TDEV:TSLP:TDEF=4:5:4. In addition, these three regions form one cycle, and a total sum of three time periods becomes T=1/f.

Figure 3:
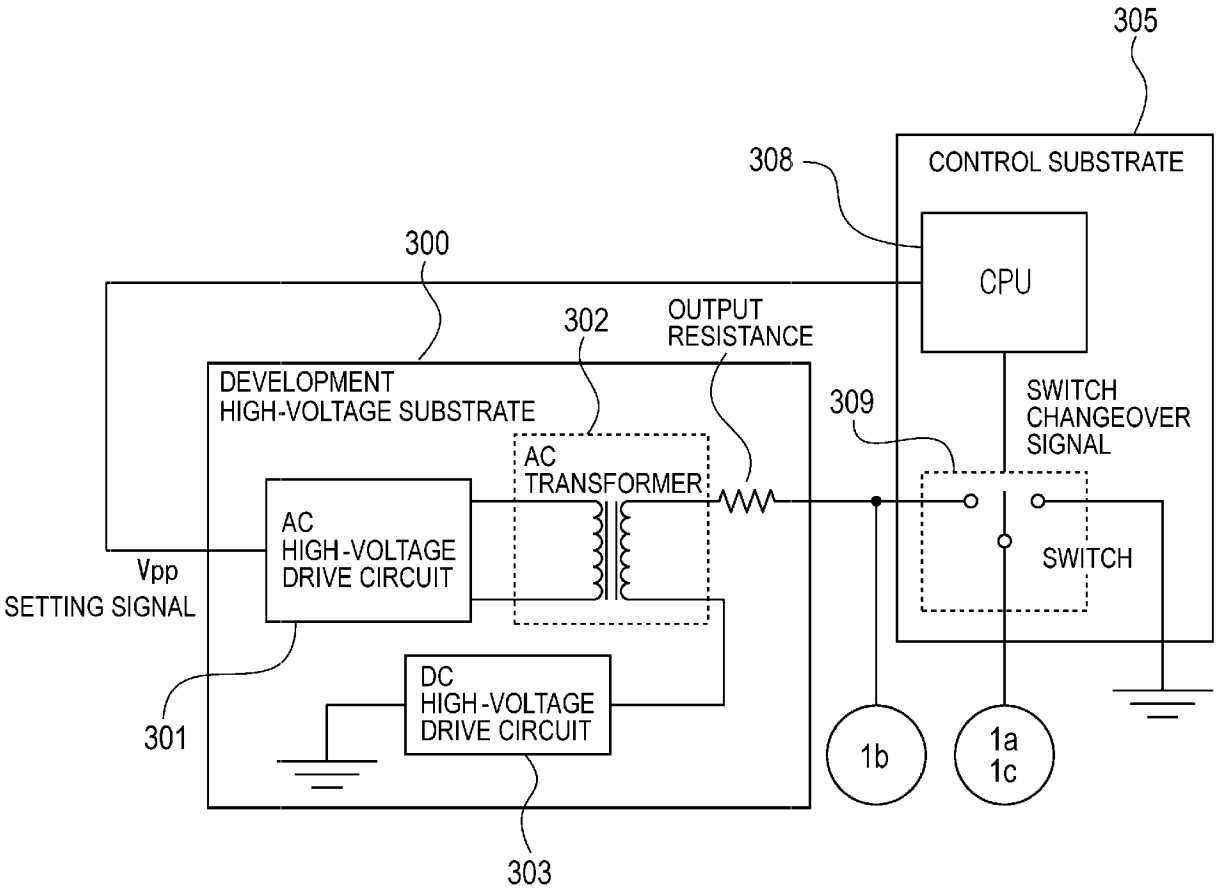
FIG. 3 is a block diagram illustrating a configuration of a development high-voltage substrate and a control substrate of the image forming apparatus according to the first embodiment.

FIG. 3 is a block diagram illustrating a configuration of a development high-voltage substrate and a control substrate of the image forming apparatus illustrated in FIG. 1. Further, the configuration illustrated in FIG. 3 is an example for realizing the bias application portion and the controller of the invention.

As illustrated in FIG. 3, the image forming apparatus is provided with a development high-voltage substrate 300 serving as the developing bias application portion and a control substrate 305 serving as the controller. The development high-voltage substrate 300 is provided with an AC high-voltage drive circuit 301, an AC transformer 302, and a DC high-voltage circuit 303. The control substrate 305 is provided with a CPU 308 (the controller) and the switch 309 (the switching portion).

In the development high-voltage substrate 300, the AC high-voltage drive circuit 301 generates an AC developing bias voltage, and supplies the generated AC developing bias voltage to the developing sleeves 1*a* and 1*b* and the regulation blade 1*c*. The DC high-voltage circuit 303 generates a DC developing bias voltage, and supplies the generated DC developing bias voltage to the developing sleeves 1*a* and 1*b* and the regulation blade 1*c*.

The CPU 308 of the control substrate 305 controls the above components, and performs image formation based on a program, a backward rotation process described below, and the operation of the switch 309.

Figure 4:
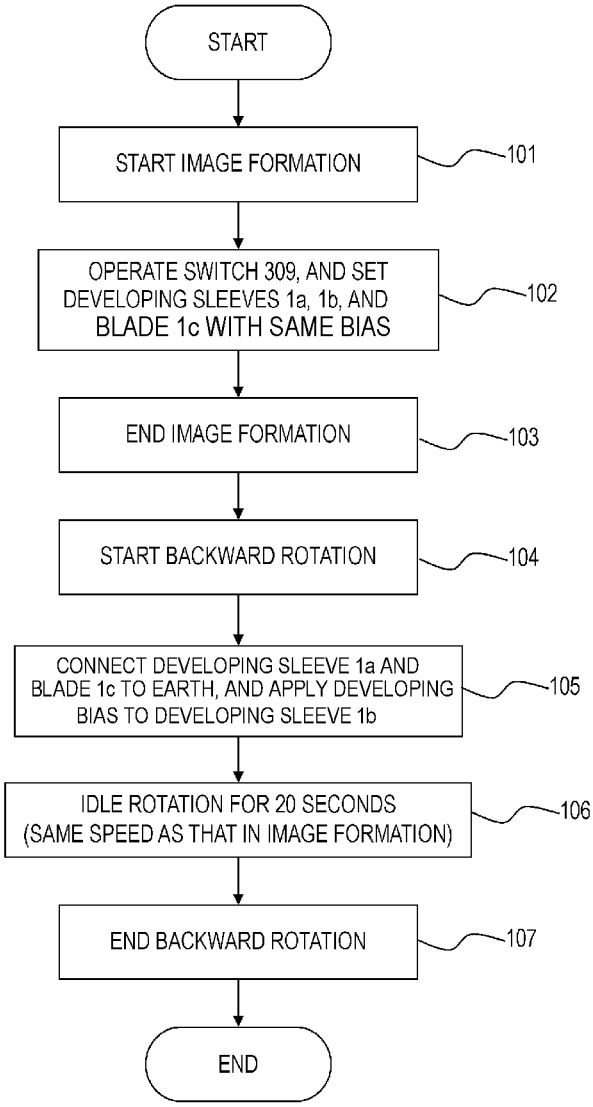
FIG. 4 is a flowchart illustrating a sequence at the time of backward rotation according to the first embodiment.

Next, a sequence at the time of backward rotation will be described using FIG. 4. Herein, the sequence (the backward rotation process) at the time of backward rotation after the image formation is ended will be described as a sequence performed at the time of non-image formation. The backward rotation process described below is a mode in which an oscillation bias is applied between the developing sleeves 1*a* and 1*b* at the time of non-image formation in a case where the oscillation bias is not applied to the developing sleeves 1*a* and 1*b* at the time of image formation. Further, the description of FIG. 4 is made about that the backward rotation process is performed after the image formation is ended, but the backward rotation process may be appropriately performed as needed at the time of non-image formation, or may not be necessarily performed at every time when the image formation is ended. Herein, the oscillation bias is a developing bias causing oscillations between the developing sleeve 1*a* and the developing sleeve 1*b*, and is a difference between the developing bias applied to the developing sleeve 1*a* and the developing bias applied to the developing sleeve 1*b*. The oscillation bias is a bias causing a temporal variation in potential between the developing sleeve 1*a* and the developing sleeve 1*b*.

When the image formation is started in step 101, the switch 309 is operated in step 102, the developing sleeve 1*a* and the regulation blade 1*c* illustrated in FIG. 1 are connected to the development high-voltage substrate 300. Therefore, the developing sleeve 1*a* and the regulation blade 1*c* illustrated in FIG. 1 become the same potential as that of the developing sleeve 1*b*. In other words, the developing sleeve 1*a* and the developing sleeve 1*b* are applied with the same developing bias. Therefore, the oscillation bias is not applied to the developing sleeves 1*a* and 1*b* at the time of image formation.

Then, an image forming operation is performed, the image formation is ended in step 103, and then the backward rotation process is started in step 104. First, the charging of the charger 2 is stopped, and the potential on the photosensitive member 11 is made to be 0 V. Then, the developing bias applied to the developing sleeve 1*a* and the developing bias applied to the developing sleeve 1*b* are made different from each other in step 105. Specifically, the switch 309 is switched to connect the developing sleeve 1*a* and the regulation blade 1*c* to the earth terminal. In other words, the developing bias of the developing sleeve 1*a* and the regulation blade 1*c* is set to about 0 V. Furthermore, an AC developing bias (an alternating current bias voltage) having a Vpp of 2 kV and a frequency of 3 kHz is applied only to the developing sleeve 1*b*. Therefore, the oscillation bias is applied between the developing sleeve 1*a* and the developing sleeve 1*b*. The oscillation bias in this example is a difference between the AC biases, that is, the developing bias applied to the developing sleeve 1*a* and the developing bias applied to the developing sleeve 1*b*.

As described above, a large amplitude of the developing bias is applied between the developing sleeves 1*a* and 1*b* by making a difference between the developing bias applied to the developing sleeve 1*a* and the developing bias applied to the developing sleeve 1*b*, and the oscillation occurs by the developing bias. Then, in a case where an agglomerate is generated between the developing sleeves 1*a* and 1*b*, the agglomerate is cracked down by the oscillation caused by the developing bias described above. Therefore, since the degradation in image quality is suppressed at the time of image formation, it is possible to prevent an image defect such as a vertical streak caused by the agglomerate interposed in a gap portion facing the developing sleeves 1*a* and 1*b* in a non-contact manner.

Thereafter, an idle rotation is performed in a predetermined time (herein, 20 seconds) in step 106. Therefore, the agglomerate including the cracked ones described above can be discharged from between the developing sleeves 1*a* and 1*b*. After the idle rotation, the backward rotation process is ended in step 107.

With the above settings, the following experiment has been performed. In other words, the backward rotation process is performed at every 100 sheets by an intermittent sheet passing of 100 sheets, and the number of vertical white streaks of a half tone image after 100,000 sheets are passed and a difference between a half tone density and the density of the vertical white streak portion have been verified. Experimental results showing the number of vertical white streaks of the half tone image and an average of the difference between the half tone density and the density of the vertical white streak portion are listed in FIG. 11. Herein, the image is formed in an A4 size and at a 20% duty.

As illustrated in FIG. 11, according to this embodiment, the number of vertical streaks of the half tone is reduced, and the difference in density of the streak portion can be hardly remarkable compared to the conventional example.

As described above, according to this embodiment, the oscillation due to the different developing biases occurs between the developing sleeves 1*a* and 1*b* at the time of non-image formation, and the agglomerate between the developing sleeves 1*a* and 1*b* is cracked down by the oscillation. Therefore, it is possible to prevent the image defect such as the vertical streak due to the agglomerate in the gap portion facing the developing sleeves 1*a* and 1*b* in a non-contact manner using a simple configuration even when the apparatus is downsized.

Second Embodiment

In a second embodiment, a larger amplitude bias is applied by setting a phase difference in AC developing biases between the developing sleeve 1*a*, the regulation blade 1*c*, and the developing sleeve 1*b*, so that the agglomerate is easily cracked down.

Figure 5:
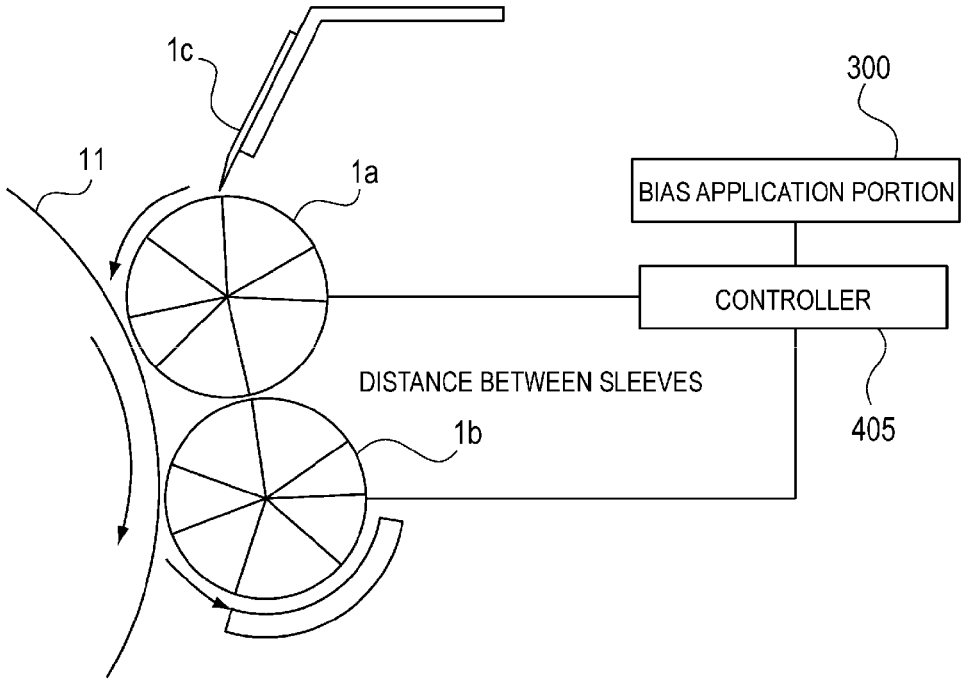
FIG. 5 is a cross-sectional view schematically illustrating an example of a configuration of a developing device of an image forming apparatus according to a second embodiment.

FIG. 5 is a cross-sectional view schematically illustrating an example of a configuration of a developing device in an image forming apparatus according to the second embodiment.

As illustrated in FIG. 5, the developing sleeves 1*a* and 1*b* and the regulation blade 1*c* are connected to the developing bias application portion 300 which applies the AC bias (the alternating current bias) and the DC bias (the direct current bias) in a superimposing manner. In addition, the developing sleeve 1*a*, the regulation blade 1*c*, and the developing sleeve 1*b* are connected to the developing bias application portion 300 through an AC bias phase controller 405. In this embodiment, the developing sleeve 1*b* is configured to supply the developing bias converted in phase using the AC bias phase controller 405 with respect to the developing sleeve 1*a* and the regulation blade 1*c*.

The amplitude Vp-p of AC component (the AC developing bias voltage) of the developing bias voltage is 2 kV, and the frequency is 3 kHz.

Figure 6:
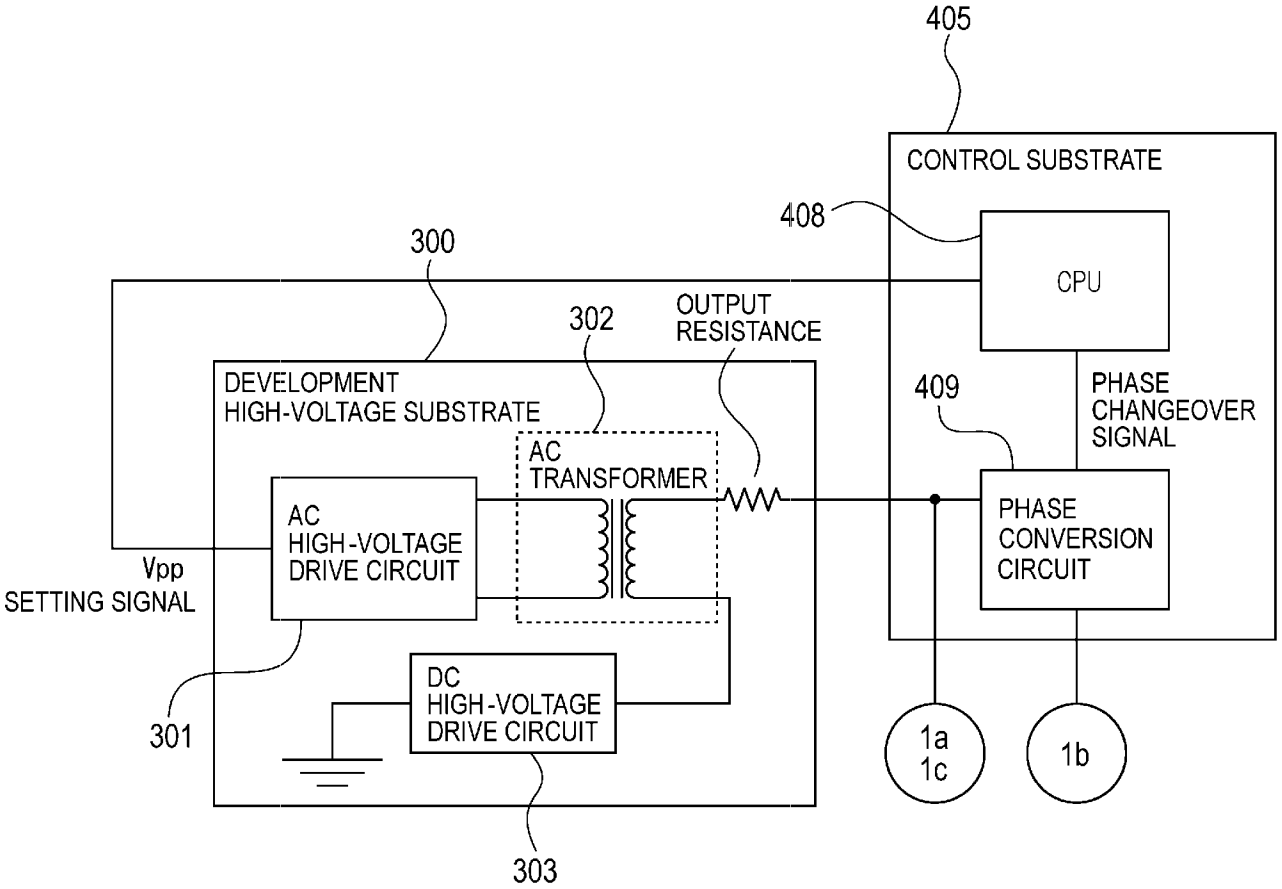
FIG. 6 is a block diagram illustrating a configuration of a development high-voltage substrate and a control substrate of the image forming apparatus according to the second embodiment.

FIG. 6 is a block diagram illustrating a configuration of a development high-voltage substrate and a control substrate of the image forming apparatus illustrated in FIG. 5. Further, the configuration illustrated in FIG. 5 is an example for realizing the bias application portion and the controller of the invention.

As illustrated in FIG. 6, the image forming apparatus is provided with the development high-voltage substrate 300 serving as the developing bias application portion and a control substrate 405 serving as the controller. The development high-voltage substrate 300 is provided with the AC high-voltage drive circuit 301, the AC transformer 302, and the DC high-voltage circuit 303. The control substrate 405 is provided with a CPU 408 (the controller) and a phase conversion circuit 409 (a phase change portion).

In the development high-voltage substrate 300, the AC high-voltage drive circuit 301 generates an AC developing bias voltage, and supplies the generated AC developing bias voltage to the developing sleeves 1*a* and 1*b* and the regulation blade 1*c*. The DC high-voltage circuit 303 generates a DC developing bias voltage, and supplies the generated DC developing bias voltage to the developing sleeves 1*a* and 1*b* and the regulation blade 1*c*.

The CPU 408 of the control substrate 405 controls the above components, and performs the image formation based on a program, a backward rotation process described below, and a phase conversion.

Figure 7:
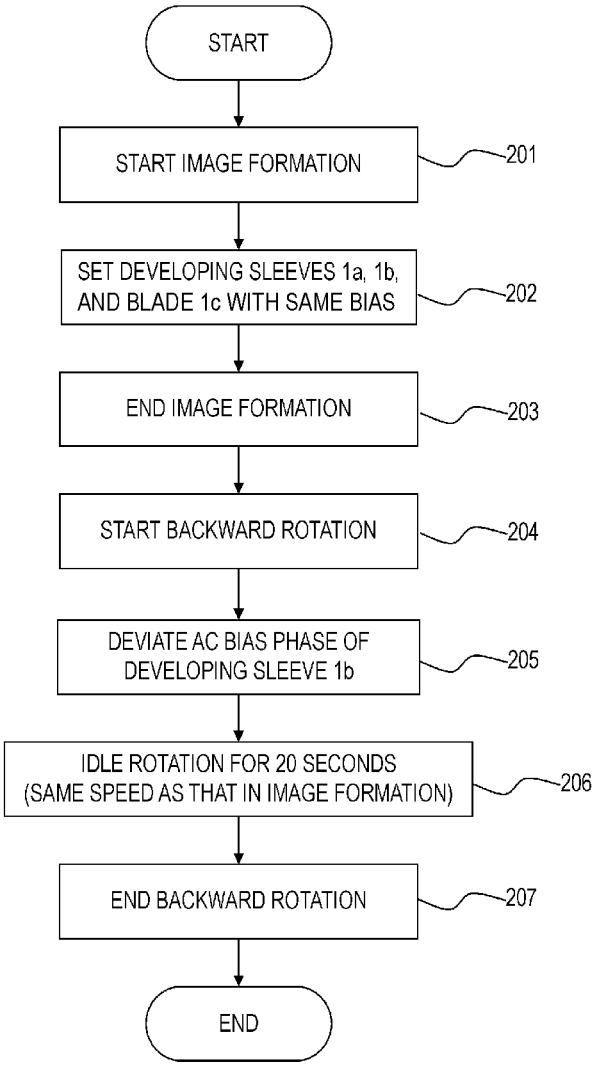
FIG. 7 is a flowchart illustrating a sequence at the time of backward rotation according to the second embodiment.

Next, a sequence at the time of backward rotation will be described using FIG. 7. Herein, the sequence (the backward rotation process) at the time of backward rotation after the image formation is ended will be described as a sequence performed at the time of non-image formation.

When the image formation is started in step 201, the developing biases of the developing sleeve 1*a*, the regulation blade 1*c*, and the developing sleeve 1*b* illustrated in FIG. 5 are in the same phase in step 202. In other words, the developing sleeve 1*a* and the developing sleeve 1*b* are applied with the same developing bias. Therefore, the oscillation bias is not applied to the developing sleeves 1*a* and 1*b* at the time of image formation.

Then, an image forming operation is performed, the image formation is ended in step 203, and then the backward rotation process is started in step 204. First, the charging of the charger 2 is stopped, and the potential on the photosensitive member 11 is made to be 0 V. Then, the phase conversion circuit 409 is operated in step 205, and the phase of the AC bias is deviated between the developing sleeve 1*a*, the regulation blade 1*c*, and the developing sleeve 1*b*, and a phase difference is generated. Herein, an AC developing bias having a Vpp of 2 kV and a frequency of 3 kHz is inversely applied to the developing sleeve 1*a*, the regulation blade 1*c* and the developing sleeve 1*b*. Therefore, the oscillation bias is applied between the developing sleeve 1*a* and the developing sleeve 1*b*.

As described above, a large amplitude of the developing bias is applied between the developing sleeves 1*a* and 1*b* by inversing the phase of the developing bias applied to the developing sleeve 1*b* to the phase of the developing bias applied to the developing sleeve 1*a*, and the oscillation occurs by the developing bias. Then, in a case where an agglomerate is generated between the developing sleeves 1*a* and 1*b*, the agglomerate is cracked down by the oscillation caused by the developing bias described above. Therefore, since the degradation in image quality is suppressed at the time of image formation, it is possible to prevent an image defect such as a vertical streak caused by the agglomerate interposed in a gap portion facing the developing sleeves 1*a* and 1*b* in a non-contact manner.

Thereafter, the idle rotation is performed in a predetermined time (herein, 20 seconds) in step 206. Therefore, the agglomerate including the cracked ones described above can be discharged from between the developing sleeves 1*a* and 1*b*. After the idle rotation, the backward rotation process is ended in step 207.

With the above settings, the following experiment has been performed. In other words, the backward rotation process is performed at every 100 sheets by an intermittent sheet passing of 100 sheets, and the number of vertical white streaks of a half tone image after 100,000 sheets are passed and a difference between a half tone density and the density of the vertical white streak portion have been verified. Experimental results showing the number of vertical white streaks of the half tone image and an average of the difference between the half tone density and the density of the vertical white streak portion are listed in FIG. 11. Herein, the image is formed in an A4 size and at a 20% duty.

As illustrated in FIG. 11, according to this embodiment, the number of vertical streaks of the half tone is reduced, and the difference in density of the streak portion can be hardly remarkable compared to the conventional example and the first embodiment.

Third Embodiment

In a third embodiment, the application portions of the AC developing biases between the developing sleeve 1*a*, the regulation blade 1*c*, and the developing sleeve 1*b* are provided separately, so that the bias of a more ideal waveform is applied and the agglomerate is easily cracked down.

Figure 8:
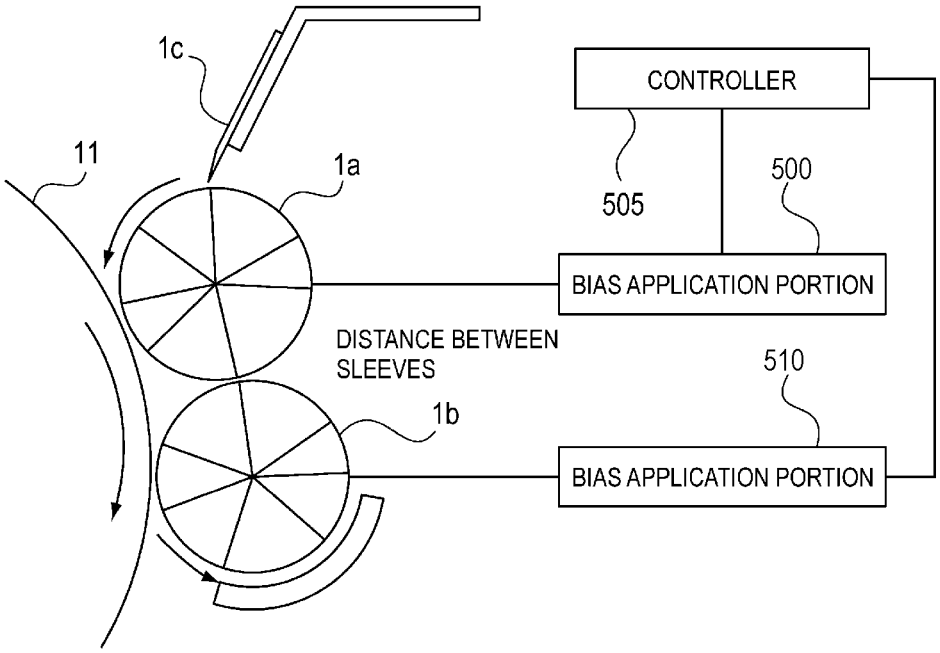
FIG. 8 is a cross-sectional view schematically illustrating an example of a configuration of a developing device in an image forming apparatus according to a third embodiment.

FIG. 8 is a cross-sectional view schematically illustrating an example of a configuration of a developing device in an image forming apparatus according to the third embodiment.

As illustrated in FIG. 8, the developing sleeve 1*a* and the regulation blade 1*c* are connected to a developing bias application portion 500 serving as a first bias application portion which applies the AC bias and the DC bias in a superimposing manner. On the other hand, the developing sleeve 1*b* is connected to a developing bias application portion 510 serving as a second bias application portion which applies the AC bias and the DC bias in a superimposing manner besides the developing bias application portion 500. The developing bias application portions 500 and 510 are connected to an AC bias controller 505 serving as the controller which controls the operation of the developing bias application portions.

The amplitude Vp-p of AC component (the AC developing bias voltage) of the developing bias voltage is 2 kV, and the frequency is 3 kHz.

Figure 9:
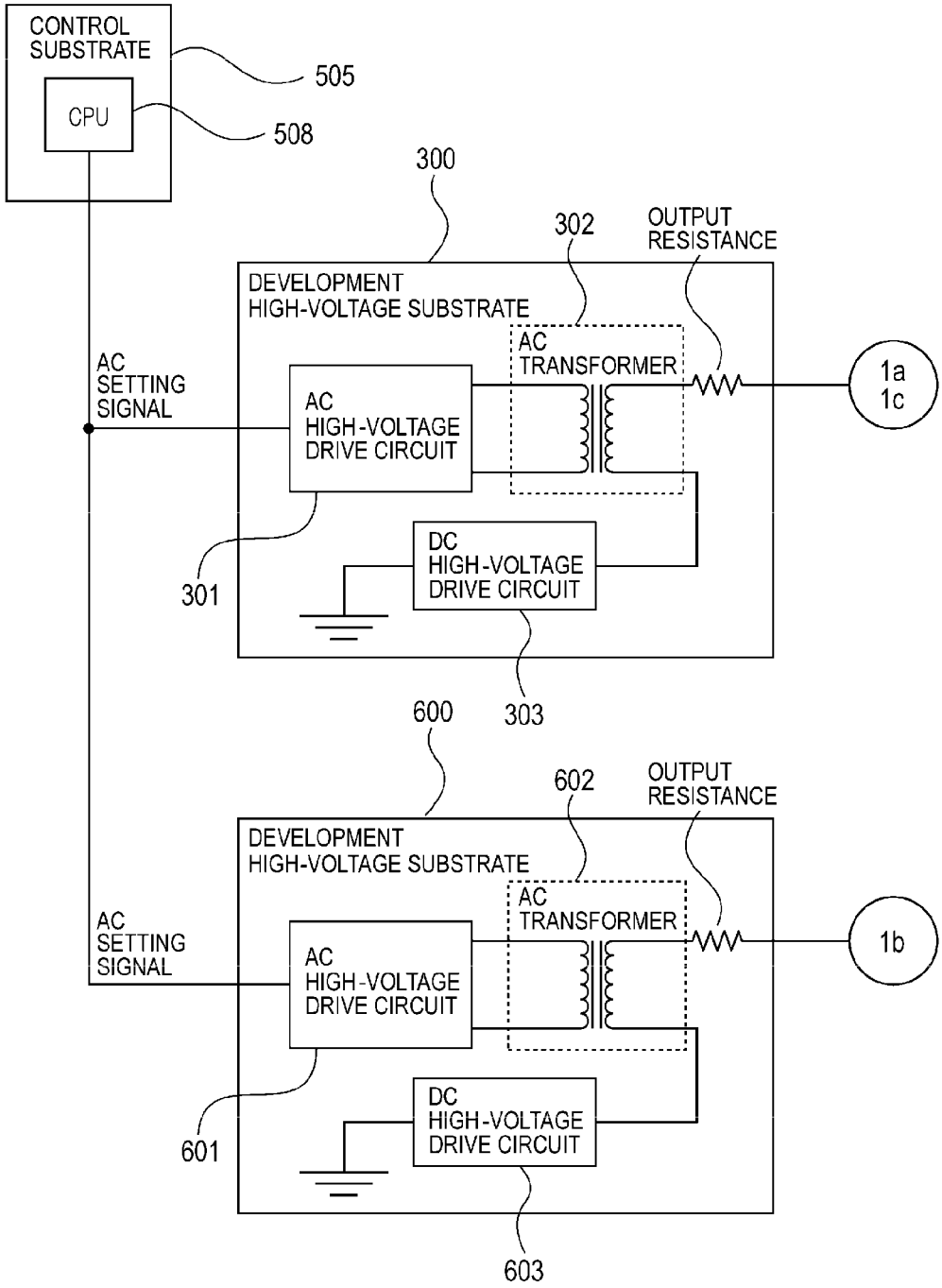
FIG. 9 is a block diagram illustrating a configuration of a development high-voltage substrate and a control substrate of the image forming apparatus according to the third embodiment.

FIG. 9 is a block diagram illustrating a configuration of a development high-voltage substrate and a control substrate of the image forming apparatus illustrated in FIG. 8. Further, the configuration illustrated in FIG. 9 is an example for realizing the bias application portion and the controller of the invention.

As illustrated in FIG. 8, the image forming apparatus is provided with the development high-voltage substrates 300 and 600 serving as the first and second bias application portions and a control substrate 505 serving as the controller. The development high-voltage substrate 300 serving as the first bias application portion is provided with the AC high-voltage drive circuit 301, the AC transformer 302, and the DC high-voltage circuit 303. The development high-voltage substrate 600 serving as the second bias application portion is provided with an AC high-voltage drive circuit 601, an AC transformer 602, and a DC high-voltage circuit 603. The control substrate 505 is provided with a CPU 508 (the controller).

In the development high-voltage substrate 300, the AC high-voltage drive circuit 301 generates an AC developing bias voltage, and supplies the generated AC developing bias voltage to the developing sleeve 1*a* and the regulation blade 1*c*. The DC high-voltage circuit 303 generates a DC developing bias voltage, and supplies the generated DC developing bias voltage to the developing sleeve 1*a* and the regulation blade 1*c*.

In the development high-voltage substrate 600, the AC high-voltage drive circuit 601 generates an AC developing bias voltage, and supplies the generated AC developing bias voltage to the developing sleeve 1*b*. The DC high-voltage circuit 603 generates a DC developing bias voltage, and supplies the generated DC developing bias voltage to the developing sleeve 1*b*.

The CPU 508 of the control substrate 505 controls the above components, performs the image formation based on a program, a backward rotation process described below, and a bias change.

Figure 10:
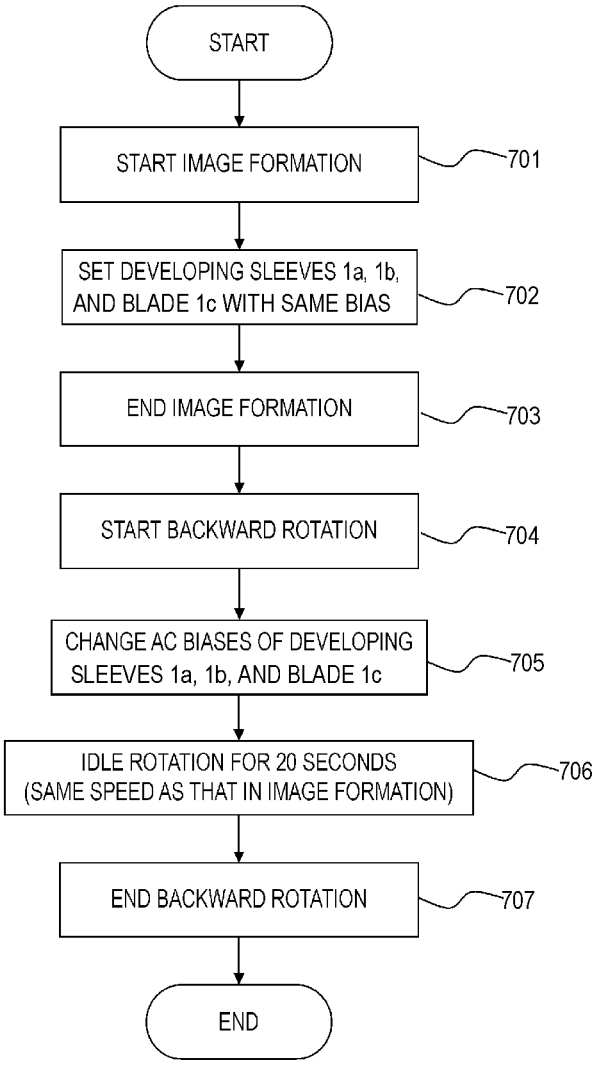
FIG. 10 is a flowchart illustrating a sequence at the time of backward rotation according to the third embodiment.

Next, a sequence at the time of backward rotation will be described using FIG. 10. Herein, the sequence (the backward rotation process) at the time of backward rotation after the image formation is ended will be described as a sequence performed at the time of non-image formation.

When the image formation is started in step 701, the developing biases of the developing sleeve 1*a*, the regulation blade 1*c*, and the developing sleeve 1*b* illustrated in FIG. 8 are applied with the same phase in step 702. Therefore, the oscillation bias is not applied to the developing sleeves 1*a* and 1*b* at the time of image formation.

Then, an image forming operation is performed, the image formation is ended in step 703, and then the backward rotation process is started in step 704. First, the charging of the charger 2 is stopped, and the potential on the photosensitive member 11 is made to be 0 V. In step 705, the development high-voltage substrate 300 and the development high-voltage substrate 600 illustrated in FIG. 9 are set to output high voltages different from each other. In this embodiment, the developing bias is changed such that a developing bias having a Vpp of 2 kV and a frequency of 3 kHz is applied to the developing sleeve 1*b*, and a developing bias having a Vpp of 4 kV and a frequency of 1.5 kHz is applied to the developing sleeve 1*a* and the regulation blade 1*c*. Further, the description has been made about that the Vpp and the frequency are changed in this embodiment, but the invention is not limited thereto. According to the configuration of this embodiment, the developing bias can be freely changed using other methods, for example, by changing the AC waveform illustrated in FIG. 2 or the DC component indicated by Vdc in FIG. 2. In this example, the oscillation bias is applied between the developing sleeve 1*a* and the developing sleeve 1*b*.

As described above, a large amplitude of the developing bias is applied between the developing sleeves 1*a* and 1*b* by changing the developing bias applied to the developing sleeve 1*a* and the developing bias applied to the developing sleeve 1*b* to be different from each other, and the oscillation occurs by the developing bias. Then, in a case where there is an agglomerate between the developing sleeves 1*a* and 1*b*, the agglomerate is cracked down by the oscillation generated by the above-described developing bias. Therefore, since the degradation in image quality is suppressed at the time of image formation, it is possible to prevent an image defect such as a vertical streak caused by the agglomerate interposed in a gap portion facing the developing sleeves 1*a* and 1*b* in a non-contact manner.

Thereafter, an idle rotation is performed in a predetermined time (herein, 20 seconds) in step 706. Therefore, the agglomerate including the cracked ones described above can be discharged from between the developing sleeves 1*a* and 1*b*. After the idle rotation, the backward rotation process is ended in step 707.

With the above settings, the following experiment has been performed. In other words, the backward rotation process is performed at every 100 sheets by an intermittent sheet passing of 100 sheets, and the number of vertical white streaks of a half tone image after 100,000 sheets are passed and a difference between a half tone density and the density of the vertical white streak portion have been verified. Experimental results showing the number of vertical white streaks of the half tone image and an average of the difference between the half tone density and the density of the vertical white streak portion are listed in FIG. 11. Herein, the image is formed in an A4 size and at a 20% duty.

As illustrated in FIG. 11, according to this embodiment, the number of vertical streaks of the half tone is reduced, and the difference in density of the streak portion can be hardly remarkable compared to the conventional example, the first embodiment, and the second embodiment.

Other Embodiments

In the embodiment described above, the description has been made about the configuration that the developing bias applied to any one of two developing sleeves at the time of non-image formation is set to be different from that at the time of image formation, and the developing bias applied to the other developing sleeve is set to be equal to that at the time of image formation. However, the invention is not limited to the above-described embodiment as long as the developing bias applied to the first developer bearing member and the developing bias applied to the second developer bearing member are set to be different from each other in order to cause the oscillation between the first developer bearing member and the second developer bearing member at the time of non-image formation.

In other words, in the above-described embodiment, the description has been made about the configuration that the oscillation bias caused by the difference (the alternating current component) between the developing biases applied to two developing sleeves is controlled to be "0" at the time of image formation, and the oscillation bias is made large at the time of non-image formation compared to the case at the time of image formation. In this way, the oscillation bias can be set to be "0" at the time of image formation, but the invention is not limited thereto. The oscillation bias may be applied at the time of image formation. In this case, the oscillation bias can be set to be small compared to that at the time of non-image formation. Further, the oscillation bias at the time of image formation may be set to be 5% or less with respect to the oscillation bias at the time of non-image formation. Even in such a configuration, the same effects as those of the above-described embodiments can be obtained.

In addition, the number of developer bearing members used is not limited to "2", but may be appropriately set as needed. In addition, the configuration of setting the developing biases to be different between the plurality of developer bearing members may be appropriately set as needed.

In addition, in the above-described embodiment, the copying machine has been exemplified as the image forming apparatus, but the invention is not limited thereto. For example, other image forming apparatuses such as a printer and a facsimile machine, or a multifunction peripheral having these functions may be employed. The same effect can be achieved by applying the invention to the image forming apparatus which includes the developing device equipped with the plurality of developer bearing members.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-089093, filed Apr. 24, 2015, which is hereby incorporated by reference herein in its entirety.

What is claimed is:

1. An image forming apparatus comprising:

an image bearing member;

a developing device that is disposed along a rotation direction with respect to the image bearing member, includes a first developer bearing member and a second developer bearing member which bears a developer, and regulates the developer of the second developer bearing member by the first developer bearing member by disposing the first developer bearing member disposed on an upstream side in the rotation direction of the image bearing member and the second developer bearing member disposed on a downstream side in the rotation direction of the image bearing member with a gap therebetween in a non-contact manner;

a bias application portion that is used to apply a first developing bias to the first developer bearing member and apply a second developing bias to the second developer bearing member, the first developing bias containing a direct current bias and an alternating current bias in a superimposing manner, the second developing bias containing a direct current bias and an alternating current bias in a superimposing manner; and a controller that controls at least one of the alternating current bias of the first developing bias applied to the first developer bearing member and the alternating current bias of the second developing bias applied to the second developer bearing member, wherein the controller is configured to be able to execute a mode in which a first difference between an amplitude of the alternating current bias of the first developing bias applied to the first developer bearing member and an amplitude of the alternating current bias of the second developing bias applied to the second developer bearing member at a time of non-image formation is set to be large compared to a second difference between an amplitude of the alternating current bias of the first developing bias applied to the first developer bearing member and an amplitude of the alternating current bias of the second developing bias applied the second developer bearing member at a time of image formation.

2. The image forming apparatus according to claim 1, wherein the controller causes one of the alternating current bias of the first developing bias applied to the first developer bearing member at the time of non-image formation to be different from the alternating current bias of the first developing bias applied to the first developer bearing member at the time of image formation and the alternating current bias of the second developing bias applied to the second developer bearing member at the time of non-image formation to be different from the alternating current bias of the second developing bias applied to the second developer bearing member at the time of image formation.

3. The image forming apparatus according to claim 1, wherein the controller includes a phase change portion that changes at least one of a phase of the alternating current bias the first developing bias and a phase of the alternating current bias of the second developing bias, and causes the phase of the alternating current bias of the first developing bias applied to the first developer bearing member to be different from the phase of the alternating current bias of the second developing bias applied to the second developer bearing member at the time of non-image formation.

4. The image forming apparatus according to claim 1, wherein the bias application portion includes a first bias application portion that is connected to the first developer bearing member and used to apply the first developing bias to the first developer bearing member and a second bias application portion that is connected to the second developer bearing member and used to apply the second developing bias to the second developer bearing member, and wherein the controller causes the alternating current bias of the first developing bias applied from the first bias application portion to the first developer bearing member to be different from the alternating current bias of the second developing bias applied from the second bias application portion to the second developer bearing member at the time of non-image formation.

5. The image forming apparatus according to claim 1, wherein at the mode, the second difference is set to be 5% or less with respect to the first difference.

6. An image forming apparatus comprising:

an image bearing member;

a developing device that is disposed along a rotation direction with respect to the image bearing member, includes a first developer bearing member and a second developer bearing member which bears a developer, and regulates the developer of a second developer bearing member by the first developer bearing member by disposing the first developer bearing member disposed on an upstream side in the rotation direction of the image bearing member and the second developer bearing member disposed on a downstream side in the rotation direction of the image bearing member with a gap therebetween in a non-contact manner;

a bias application portion that is used to apply a first developing bias to the first developer bearing member and apply a second developing bias to the second developer bearing member, the first developing bias containing a direct current bias and an alternating current bias in a superimposing manner, the second developing bias containing a direct current bias and an alternating current bias in a superimposing manner; and a controller that controls at least one of the alternating current bias of the first developing bias applied to the first developer bearing member and the alternating current bias of the second developing bias applied to the second developer bearing member, wherein the alternating current bias of the first developing bias applied to the first developer bearing member and the alternating current bias of the second developing bias applied to the second developer bearing member at a time of image formation equal each other, wherein the controller is configured to be able to execute a mode in which the the alternating current bias of the first developing bias applied to the first developer bearing member and the alternating current bias of the second developing bias applied to the second developer bearing member at a time of non-image formation differ from each other.

7. The image forming apparatus according to claim 6, wherein the controller causes at least one of the alternating current bias of the first developing bias applied to the first developer bearing member at the time of non-image formation to be different from the alternating current bias of the first developing bias applied to the first developer bearing member at the time of image formation and the alternating current bias of the second developing bias applied to the second developer bearing member at the time of non-image formation to be different from the alternating current bias of the second developing bias applied to the second developer bearing member at the time of image formation.

8. The image forming apparatus according to claim 6, wherein the bias application portion includes a first bias application portion that is connected to the first developer bearing member and used to apply the first developing bias to the first developer bearing member and a second bias application portion that is connected to the second developer bearing member and used to apply the second developing bias to the second developer bearing member, and wherein the controller causes the alternating current bias of the first developing bias applied from the first bias application portion to the first developer bearing member to be different from the alternating current bias of the second developing bias applied from the second bias application portion to the second developer bearing member at the time of non-image formation.

9. An image forming apparatus comprising:

an image bearing member;

a developing device that is disposed along a rotation direction with respect to the image bearing member, includes a first developer bearing member and a second developer bearing member which bears a developer, and regulates the developer of a second developer bearing member by a first developer bearing member by disposing the first developer bearing member disposed on an upstream side in the rotation direction of the image bearing member and the second developer bearing member disposed on a downstream side in the rotation direction of the image bearing member with a gap therebetween in a non-contact manner;

a bias application portion that is used to apply a developing bias to the first developer bearing member and the second developer bearing member, the developing bias containing a direct current bias and an alternating current bias in a superimposing manner; and a controller that controls at least one of the alternating current bias of the developing bias applied to the first developer bearing member and the alternating current bias of the developing bias applied to the second developer bearing member, wherein at a time of image formation, the developing bias is applied to the first developer bearing member and the second developer bearing member, and wherein the controller is configured to be able to execute a mode in which at a time of non-image formation, the developing bias is applied to one of the first developer bearing member and the second developer bearing member and the developing bias is not applied to the other of the first developer bearing member and the second developer bearing member.

10. The image forming apparatus according to claim 9, wherein the controller includes a switching portion that is used to connect the first developer bearing member to the bias application portion or an earth, performs switching to connect the first developer bearing member to the earth at the time of non-image formation, and applies the developing bias only to the second developer bearing member.

11. An image forming apparatus comprising:

an image bearing member;

a developing device that is disposed along a rotation direction with respect to the image bearing member, includes a first developer bearing member and a second developer bearing member which bears a developer, and regulates the developer of a second developer bearing member by a first developer bearing member by disposing the first developer bearing member disposed on an upstream side in the rotation direction of the image bearing member and the second developer bearing member disposed on a downstream side in the rotation direction of the image bearing member with a gap therebetween in a non-contact manner;

a bias application portion that is used to apply a developing bias to the first developer bearing member and the second developer bearing member, the developing bias containing a direct current bias and an alternating current bias in a superimposing manner; and a controller that controls at least one of the alternating current bias of the developing bias applied to the first developer bearing member and the alternating current bias of the developing bias applied to the second developer bearing member, wherein the controller includes a phase change portion that changes at least one of a phase of the alternating current bias of the developing bias applied to the first developer bearing member and a phase of the alternating current bias of the developing bias applied to the second developer member, wherein at a time of image formation, a phase of the alternating current bias of the first developing bias applied to the first developer bearing member and a phase of the alternating current bias of the second developing bias applied to the second developer bearing member equal each other, and wherein the controller is configured to be able to execute a mode in which the controller causes a phase of the alternating current bias of the developing bias applied to the first developer bearing member to be different from a phase of the alternating current bias of the developing bias applied to the second developer bearing member during a time of non-image formation.

* * * * *